United States Patent [19]

Glauninger et al.

[11] Patent Number: 4,475,205

[45] Date of Patent: Oct. 2, 1984

[54] APPARATUS FOR THE ELECTROSLAG REMELTING OF ALLOYS, ESPECIALLY STEEL

[75] Inventors: Helmut Glauninger, Kapfenberg; Heimo Jäger, Bruck an der Mur; Peter Machner, Leoben; Albert Preiner, Pernegg, all of Austria

[73] Assignee: Vereinigte Edelstahlwerke AG (VEW), Vienna, Austria

[21] Appl. No.: 439,062

[22] Filed: Nov. 3, 1982

[30] Foreign Application Priority Data

Nov. 13, 1981 [AT] Austria ..... 4884-81

[51] Int. Cl.[3] ..... H05B 7/11; H05B 3/60

[52] U.S. Cl. ..... 373/48

[58] Field of Search ..... 373/48, 47, 45, 44, 373/103

[56] References Cited

U.S. PATENT DOCUMENTS 4,262,159 4/1981 Gröf et al. ..... 373/48

FOREIGN PATENT DOCUMENTS 286514 12/1970 Austria .

1191520 12/1965 Fed. Rep. of Germany .

2123368 3/1977 Fed. Rep. of Germany .

2028068 8/1978 United Kingdom .

*Primary Examiner*—Roy N. Envall, Jr.

*Attorney, Agent, or Firm*—Werner W. Kleeman

[57] ABSTRACT

An electroslag remelting furnace includes a liquid-cooled, open-ended mold supported by a bottom plate of high electric conductivity, for instance, formed of copper, which closes the mold at one of its ends. The mold has a plane of symmetry which contains a mold axis. At least one conductor connects at least one terminal located at the bottom plate to a source of electric current. Furthermore, the mold has a normal plane extending normally with respect to the symmetry plane which contains the mold axis. The electric conductor extends from a marginal zone on one side of the bottom plate to the terminal on the other side of the bottom plate beyond the normal plane.

13 Claims, 4 Drawing Figures

APPARATUS FOR THE ELECTROSLAG REMELTING OF ALLOYS, ESPECIALLY STEEL

BACKGROUND OF THE INVENTION

The present invention broadly relates to an improved electroslag remelting furnace including a liquid-cooled mold adapted to receive a slag bath and a block of a partially molten metal or metal alloy covered by said slag bath during electroslag remelting. The furnace also comprises at least one melt-off electrode formed by said metal or metal alloy which electrode is arranged to extend into the slag bath from an open end of the mold and substantially centrally with respect thereto.

In its more particular aspects, the furnace includes, especially but not exclusively a bottom plate of the type which has high electric conductivity, for instance formed of copper, and which forms a closed end of the mold so as to support the mold and the block formed by remelting. At least one electrical terminal or connection is provided at the bottom plate and is adapted to be connected to an electric current source by means of a conductor. The terminal is disposed in spaced relationship from a mold axis and it is also typically disposed substantially symmetrically with respect to a plane of symmetry which includes the mold axis. Such furnaces are used for remelting alloys, particularly alloyed steel.

In such a furnace the electrode is immersed into the slag bath and it is molten-off or melted by resistance heating. Thereby, a block is formed continuously which rises from the bottom plate arranged at the closed end of the mold. In such a process steel of particularly high metallurgical quality is obtained because of the specifically high purifying effect the slag has upon the melt slowly dropping therethrough. The then solidifying melt, therefore, may have a particularly high degree of purity so that segregations and contaminations are avoided. Another prerequisite to obtain a particularly homogeneous block is an intended uniform solidification of the metal melt. This intended uniform solidification of the melt not only requires a uniformly cooled mold, but the observance of other additional effects.

For example, if the melting-off electrode is not exactly centered or, respectively, if the melting-off electrodes are not arranged symmetrically with respect to the mold axis, then the electrode(s) may melt off asymmetrically; on the other hand, an asymmetric crystallization of the block may thus result. This effect, however, is not only due to an increased heat supply from the electrode directly to the slag and to the metal melt in this region, but it is due, also, to nonuniform motion within the slag in the mold. Consequently, the slag will become preferably cooled in places, in which the motion is low or zero, so that the slag solidifies to a higher degree and forms a thicker cover or blanket of solidified slag in this region as compared to the remaining wall regions.

From this discussion the importance of slag motion will become evident. As such, the slag and the melt, too, are paramagnetic. However, the slag serves as an electric conductor and as such will be subject to the built-up electromagnetic field, whereby a stirring motion occurs within the slag. This particular component of the stirring motion within the slag will be independent of whether a direct-current or a low or a high-frequency alternating-current is used, respectively. It has been observed, particularly in the case of large block diameters, and, especially when using low-frequency alternating-current, for example, in the range of 3 to 10 Hz, that the motion of the slag in the mold will become asymmetric. It has already been assumed that one reason for this asymmetric motion may be the Coriolis force. Furthermore, attempts have been made to achieve mutual balance of the electromagnetic fields by an arrangement of the electric conductors which is as symmetric as possible.

Due to the skin effect and to shielding by the mold difficulties of the kind as mentioned before will be less when higher frequency alternating-currents are used. Up to now no exact scientific explanation could be found for the aforementioned phenomena since the here occurring effects are superimposed upon one another in many ways. Thus, slag motion does not only occur due to forces generated by the electric current; additionally other effects are present which, for instance, result from the temperature gradient within the slag. Furthermore, the electromagnetic fields may be shielded or affected by ferromagnetic material which is always present in a steel mill. While such shielding from electromagnetic fields may eliminate or reduce spurious effects or interferences, the total energy consumption per unit of remelted metal alloy may become substantially increased.

SUMMARY OF THE INVENTION

Therefore, with the foregoing in mind it is a primary object of the present invention to provide an improved construction of an electroslag remelting furnace for metal alloys which can be used particularly for remelting steel.

Another and more specific object of the present invention aims at the provision of a new and improved construction of an electroslag remelting furnace of the aforementioned type which operates preferably at low frequencies, for example, in the range of 3 to 10 Hz.

Still a further significant object of the present invention is directed to a new and improved construction of an electroslag remelting furnace of the aforementioned kind which permits the effective formation of block diameters above 1 meter, particularly above 2 meters.

Another, still important object of the present invention is directed to a new and improved construction of an electroslag remelting furnace of the aforementioned type in which essentially completely uniform solidification of the block is obtained already in the base portion thereof.

Still another important object of the present invention is directed to a new and improved construction of apparatus for the electroslag remelting of alloys, especially steel, which is relatively simple in construction and design, quite economical to manufacture, extremely easy to use, and not readily subject to breakdown or malfunction.

Now in order to implement these and still further objects of the invention, which will become more readily apparent as the description proceeds, the apparatus of the present development is manifested by the features that, there is provided at least one conductor extending from a marginal region or zone of the bottom plate beyond a plane extending normally with respect to the plane of symmetry, said normal plane being arranged at least near to and preferably includes the mold axis.

While the electromagnetic forces are not balanced in such an arrangement, it has been found that the slag motion and thereby the cooling of the steel in the mold may be achieved in a completely uniform manner, even if low-frequency alternating-current of 3 to 10 Hz is used and blocks of particularly large diameters are produced, when the current source is connected to the bottom plate in accordance with the invention.

According to a further feature of the invention, the at least one electric conductor preferably extends below the bottom plate at least up to the normal plane extending normally or at right angles with respect to said plane of symmetry. In this respect it is of advantage if the distance of the conductor from the bottom plate increases from the related marginal zone or region where the terminal is connected to the bottom plate towards the normal plane.

In such an arrangement the electric conductor may extend at an angle with respect to the bottom plate in order to adapt the arrangement, especially the terminal or terminals to respective local conditions, like shielding effects by parts of the plant and others.

When the at least one conductor extends below the bottom plate at least up to the normal plane, the electromagnetic fields generated by the currents in the bottom plate are balanced in a particularly simple manner and in a space saving way at the region of the base of the block to be formed.

When at least two terminals are provided at the bottom plate and the branch conductors extending therefrom are joined to form a single conductor at the region of the mold axis or, respectively, at the region of the normal plane, an essentially uniform electrical conductivity in the block or, respectively, initially in the slag, will be obtained even with bottom plates of lower electric conductivity, while simultaneously avoiding the undesired effects of the asymmetric stirring motion within the slag.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
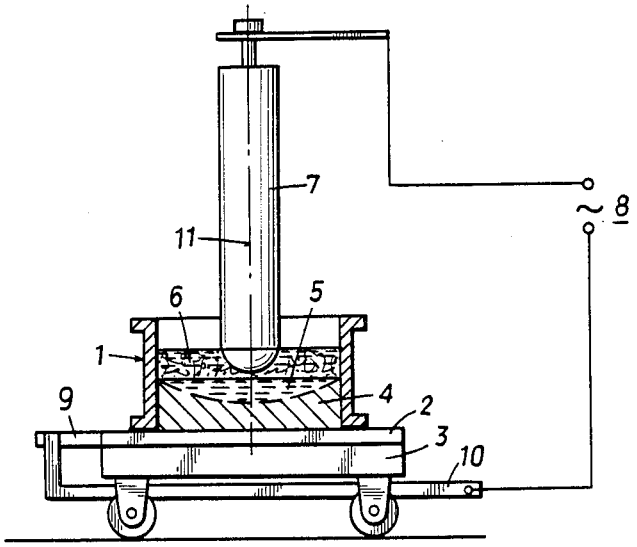
FIG. 1 is a schematic representation of an electroslag remelting furnace according to the invention, partly in section.

Describing now the drawings, it is to be understood that only enough of the construction of the electroslag remelting furnace or apparatus has been shown as needed for those skilled in the art to readily understand the underlying principles and concepts of the present development, while simplifying the showing of the drawings. Turning attention now specifically to FIG. 1, there has been illustrated schematically therein an open-ended, liquid-cooled mold 1 with a bottom plate 2 to close one end thereof. The mold 1 including the bottom plate 2 is placed on a suitable carriage 3. The mold 1 is, for instance, water-cooled and contains already solidified molten metal or metal melt 4 in the form of a block which is covered by still liquid melt 5 and a blanket of liquid slag 6. A melt-off electrode 7 is immersed in the liquid slag 6. The melt-off electrode 7 is in electric conductive connection with a suitable current or power source 8 which may be constituted by a transformer. The mold 1 as well as the electrode 7 are each retained in mutually independent conventional retaining or holding means which do not form part of the invention and, therefore, are not here illustrated further. While the mold 1 is raised in accordance with the growth of the block 4, the electrode 7 is lowered gradually in correspondence with the amount of molten material melted-off therefrom and with the slowly rising level of the melt. The bottom plate 2 contains a marginal region or zone 2*a* and has a terminal or connection 9 located at the neighborhood thereof.

Figure 2:
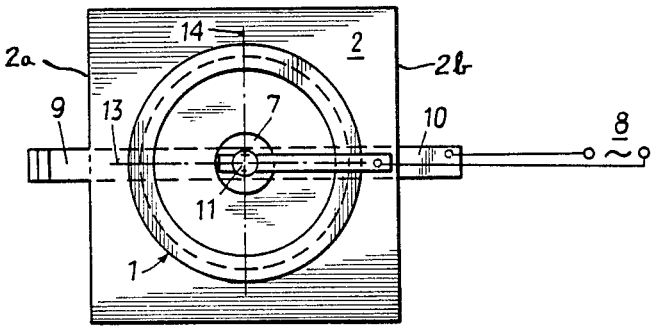
FIG. 2 is a top plan view of the furnace shown in FIG. 1.

The terminal 9 is in electric conducting connection with the transformer 8 or equivalent structure by means of an electric conductor 10 which extends below the bottom plate 1 in such a way that it passes through a normal plane 14 at the region of the lengthwise axis 11 of the mold 1, which here also constitutes the mold symmetry axis. As will be recognised particularly from FIG. 2, the electric conductor 10 extends at the side of the other marginal region or zone 2*b* of the bottom plate 2, in a hypothetical plane of symmetry 13 (as defined by the sole terminal 9 or by the conductor 10 itself) beyond the normal plane 14 which includes the mold symmetry lengthwise axis 11 and which normal plane 14 extends normally with respect to the plane of symmetry 13.

The electrical conductor 10, starting from the transformer 8, thus is led to extend below the bottom plate 2, and is connected with the terminal 9 at the side or marginal region 2*a* of the bottom plate 2 which is opposite the transformer 8.

Figure 3:
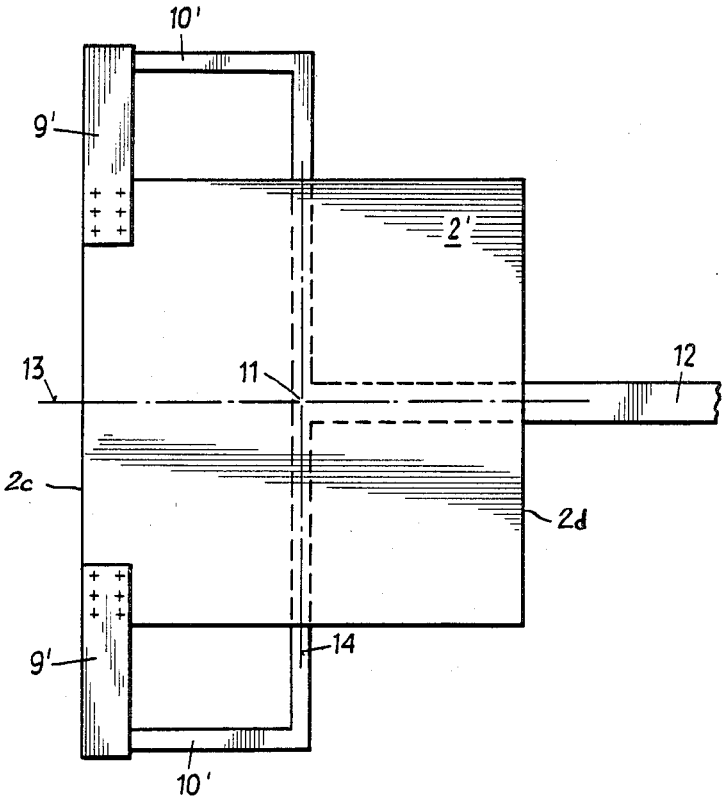
FIGS. 3 and 4 respectively show different connecting configurations or arrangements with respect to the bottom plate for the furnace shown in FIG. 1.

FIG. 3 shows a bottom plate 2′ having two terminals or connections 9′ at the marginal region or zone 2*c*. Correspondingly two electrical branch conductors or lines 10′ are provided. The branch conductors 10′ are led below the bottom plate 2′ up to the normal plane 14 and, then, to the symmetry plane 13 where they are joined to form a single conductor 12 leading past the opposite marginal zone or region 2*d* of the bottom plate 2′ to the current source 8. Again it will be understood that the conductor 12 and its branch portions or conductors 10′, viewed from the side of the current source 8, extend from such current source, past the marginal zone 2*d* and past the normal plane 14 to the terminals 9′.

Figure 4:
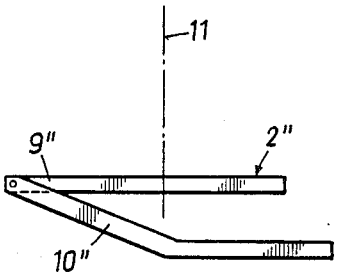

In the schematic representation of FIG. 4, the terminal 9″ of a bottom plate 2″ is connected to a conductor 10″. The conductor 10″ is spaced at an increasing distance from the bottom plate 2″ up to the region of the mold axis 11 and is, then, led roughly in parallelism to the bottom plate 2″ beyond the same.

In case that the electric conductor 10 does not extend below the bottom plate, but, for example, above the same or at the same level, such electric conductor will have to be extended beyond the normal plane 14 which extends through the mold axis and normally with respect to the resultant of the current direction in the bottom plate.

In an electroslag remelting furnace as shown in FIG. 1 a block having a diameter of 1.5 meters has been molten using low-frequency alternating-current of 5 Hz. Already at the beginning of the remelting operation the motion within the slag was completely symmetric with respect to the mold axis.

If the electrical conductor in this furnace does not run below the bottom plate and if the terminal is arranged so as to be located immediately adjacent to the transformer, an asymmetric motion will occur within the slag so that different cooling rates will result within the block.

While there are shown and described present preferred embodiments of the invention, it is to be distinctly understood that the invention is not limited thereto, but may be otherwise variously embodied and practiced within the scope of the following claims. Accordingly,

What we claim is:

1. An electroslag remelting furnace comprising:
a liquid-cooled mold having opposed ends;
said mold confining therein a slag bath and a block formed of at least one partially molten metal covered by said slag bath during electroslag remelting;
at least one melt-off electrode formed by said at least one metal;
said melt-off electrode being immersed into said slag bath from one of said opposed ends of said mold defining an open end and being arranged substantially centrally with respect to said mold;
said mold having a mold axis;
a bottom plate of predetermined electric conductivity for closing the other opposed end of said mold and being arranged to support said mold and said block;
said bottom plate having a margin which defines a marginal zone of said bottom plate;
at least one electrical terminal provided at said marginal zone of said bottom plate and disposed at a distance from said mold axis and adapted to be connected to an electric current source;
an electric current source;
at least one conductor connecting said at least one electrical terminal to said current source;
said mold possessing a symmetry plane defined by said at least one conductor;
said mold axis extending in said symmetry plane;
a normal plane extending substantially normally with respect to said symmetry plane and located at the region of said mold axis;
said margin defining said marginal zone of said bottom plate being located to one side of said normal plane and said electric current source being located at an opposite side of said normal plane remote from said one side;
each said at least one electrical terminal only being located at said marginal zone at said one side of said normal plane remote from said electrical current source; and
said at least one conductor which connects said current source with said at least one electrical terminal extending from said marginal zone at least up to said normal plane.

2. The electroslag remelting furnace as defined in claim 1, wherein:
said at least one conductor extends from the marginal zone past the normal plane beneath the bottom plate.

3. The electroslag remelting furnace as defined in claim 1, wherein:
said mold axis defines a mold symmetry axis; and
said mold symmetry axis lying in said symmetry plane.

4. The electroslag remelting furnace as defined in claim 1, wherein:
said normal plane contains said mold axis.

5. The electroslag remelting furnace as defined in claim 1, wherein:
said at least one conductor extends from the marginal zone at least to the normal plane below the bottom plate.

6. The electroslag remelting furnace as defined in claim 5, wherein:
said at least one conductor extends from said at least one electrical terminal to the normal plane at an increasing distance of said conductor from the bottom plate.

7. The electroslag remelting furnace as defined in claim 1, wherein:
said at least one conductor extends from said at least one electrical terminal to the normal plane at an increasing distance of said conductor from the bottom plate.

8. The electroslag remelting furnace as defined in claim 1, wherein:
two of said electrical terminals are provided for the bottom plate;
said at least one conductor defines a single conductor which extends from the current source up to the region of the normal plane; and
branch conductors leading from said single conductor at the region of said normal plane to said terminals.

9. The electroslag remelting furnace as defined in claim 1, wherein:
said bottom plate is formed of a material possessing a high electrical conductivity.

10. The electroslag remelting furnace as defined in claim 9, wherein:
said material of said bottom plate is copper.

11. An electroslag remelting furnace comprising:
an open-ended mold defining an open end and a closable mold end opposite said open end;
said mold having a lengthwise axis and a symmetry plane;
an electrically conductive bottom plate closing said opposite end of said mold and being arranged to support said mold;
said bottom plate having a margin which defines a marginal zone of said bottom plate;
at least one electrical terminal provided for said bottom plate in spaced relationship from said mold lengthwise axis for connection to a power source;
means defining a power source;
at least one conductor connecting said at least one electrical terminal to said power source;
said symmetry plane being defined by said at least one conductor and said mold lengthwise axis essentially lying in said symmetry plane;
a normal plane extending essentially normally with respect to said symmetry plane;
said margin defining said marginal zone of said bottom plate being located to one side of said normal plane and said power source being located at an opposite side of said normal plane remote from said one side;
each said at least one electrical terminal only being located at said marginal zone at said one side of said normal plane remote from said power source; and
said at least one conductor extending from said power source past said marginal zone of said bottom plate and past said normal plane to said at least one electrical terminal.

12. The electroslag remelting furnace as defined in claim 11, wherein:

said at least one electrical terminal and said power source are located on opposite sides of the normal plane.

13. An electroslag remelting furnace comprising:

a liquid-cooled mold having opposed ends;

said mold confining therein a slag bath and a block formed of at least one partially molten metal covered by said slag bath during electroslag remelting;

at least one melt-off electrode formed by said at least one metal;

said melt-off electrode being immersed into said slag bath from one of said opposed ends of said mold defining an open end and being arranged substantially centrally with respect to said mold;

said mold having a mold axis;

a bottom plate of predetermined electric conductivity for closing the other opposed end of said mold and being arranged to support said mold and said block;

said bottom plate having a margin which defines a marginal zone of said bottom plate on one side of said mold axis;

at least one electrical terminal provided at said marginal zone of said bottom plate located at said one side of said mold axis and disposed at a distance from said mold axis for connection to an electric current source;

an electric current source;

at least one conductor connecting said at least one electrical terminal to said electric current source;

said mold defining a further side which is opposite to said at least one electrical terminal located at said one side of said mold axis;

said at least one conductor extending from said at least one electrical terminal at said marginal zone of said bottom plate towards said further side of said mold which is located opposite to said at least one electrical terminal located at said one side of the mold axis; and each said at least one electrical terminal and the electric current source are arranged on opposite sides with respect to said mold axis.

* * * * *